United States Patent [19]

Kawamura et al.

[11] Patent Number: 4,866,289

[45] Date of Patent: Sep. 12, 1989

[54] WINDING-FORM INSPECTING APPARATUS FOR WOUND-YARN PACKAGES

[75] Inventors: Shuzo Kawamura; Kenichi Inada, both of Joyo, Japan

[73] Assignee: Murata Kikai Kabushiki Kaisha, Kyoto, Japan

[21] Appl. No.: 905,744

[22] Filed: Sep. 9, 1986

[30] Foreign Application Priority Data

Sep. 10, 1985 [JP] Japan ..... 60-200877

[51] Int. Cl.[4] ..... G01N 21/88

[52] U.S. Cl. ..... 250/572; 250/562; 356/238

[58] Field of Search ..... 250/561, 562, 571, 572; 139/273 A; 356/238, 429, 430; 242/28, 36, 49, 57

[56] References Cited

U.S. PATENT DOCUMENTS

| | | | |
|---|---|---|---|
| 3,712,743 | 1/1973 | Harris et al. | 250/572 |
| 3,777,168 | 12/1973 | Sansone | 356/238 |
| 3,801,031 | 4/1974 | Kamp et al. | 250/561 |
| 3,892,492 | 7/1975 | Eichenberger | 250/571 |
| 4,091,368 | 5/1978 | Schwartz | 250/571 |
| 4,221,242 | 9/1980 | Eichenberger | 139/273 A |
| 4,276,910 | 7/1981 | Eichenberger | 250/561 |

*Primary Examiner*—Edward P. Westin

*Attorney, Agent, or Firm*—Spensley Horn Jubas & Lubitz

[57] ABSTRACT

A winding-form inspecting apparatus for wound-yarn packages comprising a first projecting portion for irradiating light against the surface of a yarn layer of a package substantially at right angles thereto, a first light receiving portion for receiving a reflecting light caused by the first projecting portion, a second projecting portion for irradiating light against the surface of the yarn layer in an oblique direction, and a second light receiving portion for receiving a reflecting light caused by the second projecting portion.

2 Claims, 5 Drawing Sheets

WINDING-FORM INSPECTING APPARATUS FOR WOUND-YARN PACKAGES

FIELD OF THE INVENTION AND RELATED ART STATEMENT

The present invention relates to a winding-form inspecting apparatus for wound-yarn packages.

Wound-yarn packages, wound by an automatic winder, a twisting machine, or the like, are sometimes found to be defective in their winding-form due to various causes. For example, FIGS. 10 (I) to (V) show typical examples of inferior winding-forms of cone packages wound by an automatic winder.

FIG. 10 (I) shows a cob-webbing package P1 wherein, at the package end T, the wound yarn Y1 deviates outside the yarn layer. FIG. 10 (II) shows a de-ended package P2 wherein no yarn is present on a bobbin on the yarn feed side, a yarn end Y2 is fallen from the package end and wound around a take-up tube K when a yarn breakage occurs or the yarn enters into the yarn layer. FIG. 10 (III) shows a package P3 exhibiting winkles G which result from the lowering of tension due to a reduction in traverse at the beginning of winding, a slip or the like, or a bulge. FIG. 10 (IV) shows a stepped-wound package P4 having an inflated stepped portion N formed at one end as a result of lack of tension or ribbon winding. FIG. 10 (V) shows a package P5 having a growth ring which results from variations in release tension due to a defect in the shape of a spinning bobbin on the yarn feed side.

The above-described examples show cases in which the defect in winding form is created at the end of the package. It is, of course, known that a defect in winding-form may also occur in the outer peripheral surface of the package.

In any case, when such defective packages are used without modification in knitting machines and looms, yarn-releasing cannot be carried out smoothly. This results in a great variation in tension, slip-out, or the like, which leads to yarn breakages.

Accordingly, wound-yarn packages doffed from a winder are generally submitted to a winding-form inspection, conducted visually by an operator, prior to transporting the package to a succeeding step.

Fine defective portions are sometimes overlooked in the above-described inspection method. Errors in checking may also occur, depending upon the angle of visual inspection.

OBJECT AND SUMMARY OF THE INVENTION

It is an object of the present invention to provide an apparatus capable of inspecting various defective portions of packages.

The present invention provides an apparatus comprising a first projecting means for irradiating light against the yarn layer surface of a package substantially at right angles thereto, a second projecting means for irradiating light against the yarn layer surface at an oblique angle thereto, a first light receiving means for receiving reflected light caused by the first projecting means, and a second receiving means for receiving reflected light caused by the second projecting means.

Certain defects in the surface of the yarn layer (such as cob-webbing) will cause a shadow to be cast by light irradiated from the first light source. Other defects in the surface of the yarn layer (such as a stepped winding or winkles) will cause a shadow to be cast by light irradiated from the second light source. Thus, defective portions which are most likely to be overlooked by a single light source can be detected.

BRIEF DESCRIPTION OF THE DRAWNGS

Figure 10:
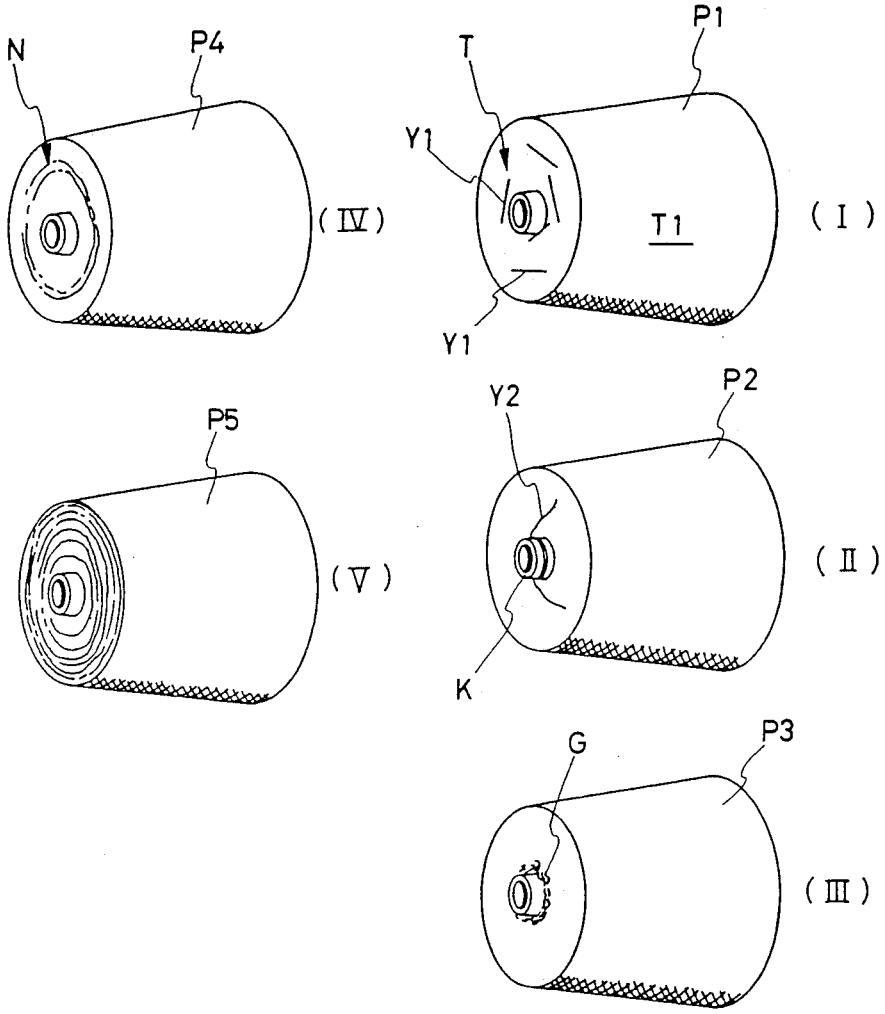

FIG. 10 (I) to (V) are perspective views, respectively, showing typical examples of a package with a defective winding-form.

DETAILED DESCRIPTION OF PREFERRED EMBODIMENTS

Embodiments of the present invention will now be described with reference to the drawings.

Figure 1:
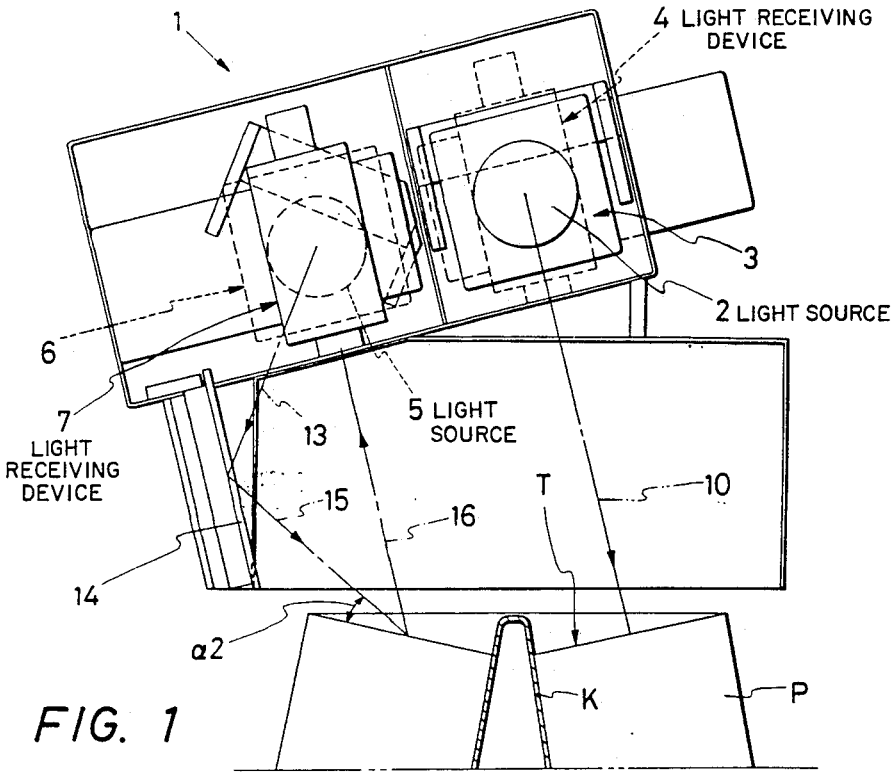
FIG. 1 is a side view showing an embodiment of an apparatus according to the present invention.
Figure 2:
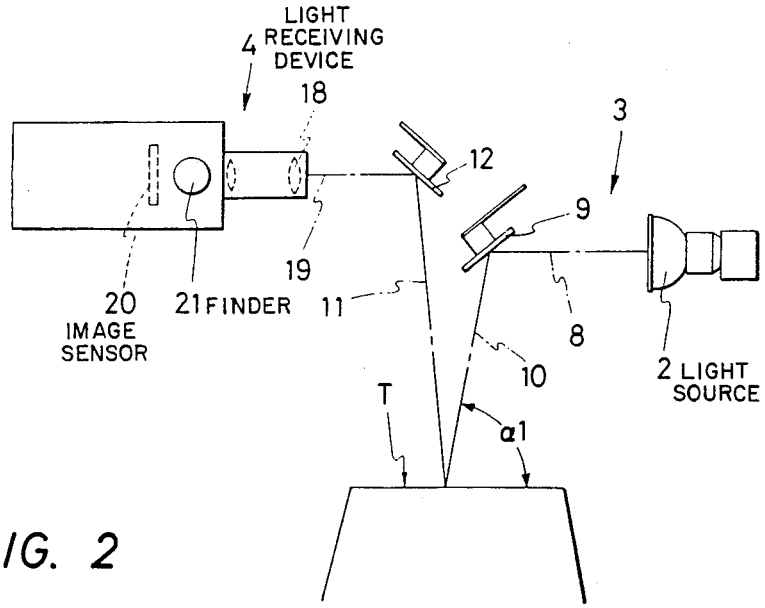
FIG. 2 is a front view showing the relationship between a first projecting means and light receiving means, and an optical axis.
Figure 3:
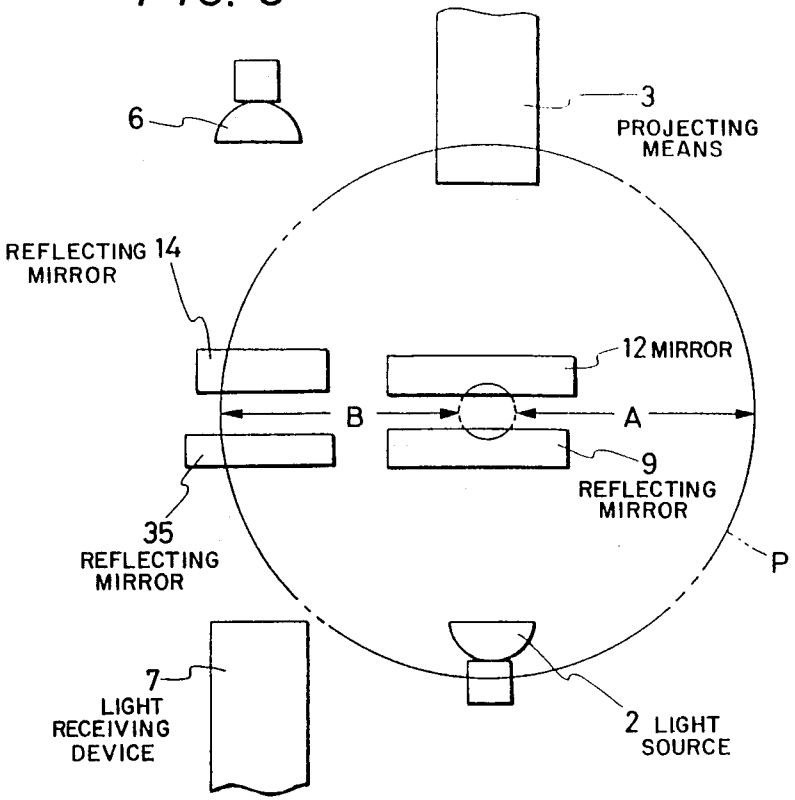
FIG. 3 is a plan view showing the arrangement of a first and a second projecting means and light receiving means.

Referring to FIGS. 1 to 3, an inspecting device 1 comprises a first projecting means 3 having a lens and a first light source 2 for irradiating light against the surface T of a yarn layer. A first light receiving means 4 is provided having an image sensor and a lens for receiving light reflected by the surface T. A second projecting means 6 has a lens and a further light source 5 for irradiating light against the surface T. A second light receiving means 7 is provided with an image sensor and a lens for receiving light reflected by the surface T.

Light 8 from the first projecting means 3 is irradiated at 10 substantially at right angles to the surface T through a reflecting mirror 9. Light 11 reflected by the surface T is incident upon the first light receiving means 4 through a mirror 12. The light 8 comprises a parallel beam.

The angle of incidence ($\alpha 1$) of the optical axis of the light beam 10 preferably is as close as possible to 90° with respect to the surface T. However, it is not possible to make the angle exactly equal to 90°. Therefore, the angle of incidence of the optical axis of the light beam 10 may be referred to as being substantially at right angles to the surface T.

A reflecting mirror 14 is inclined so that the light 13 from the second projecting means 6 is irradiated at a small angle ($\alpha 2$) with respect to the surface T by means of the reflecting mirror 14. The angle ($\alpha 2$) is selected to be in the range of $0° < \alpha 2 < 45°$. More specifically, the relationship of $\alpha 1 > \alpha 2$ is established between the angles ($\alpha 1$) and ($\alpha 2$).

Figure 4:
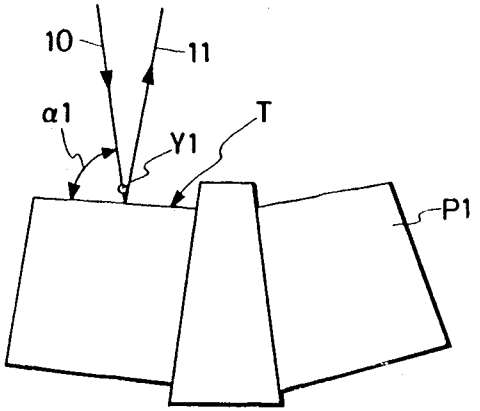
FIG. 4 is an explanatory view showing the reflecting angle of light irradiated from the first projecting means.

FIG. 4 illustrates an example in which the cob-webbing yarn Y1 is raised from the surface T. The light 10 is irradiated against the yarn Y1. The yarn Y1 casts a shadow on the surface T of the yarn layer. When the angle ($\alpha 1$) is small, the distance from the yarn Y1 to the shadow on the surface T of the yarn layer increases. As a result, the shadow becomes dim and it becomes difficult to distinguish between the quantity of light reflected by the shadow region and the quantity of light reflected by the other, normal yarn-layer surface regions. The shadow region becomes clearer by adjusting the incident angle ($\alpha 1$) to be as close as possible to 90°. Accordingly, the first projecting means 3 and the light receiving means 4 are particularly well suited for use in inspecting a package having cob-webbing.

Figure 5:
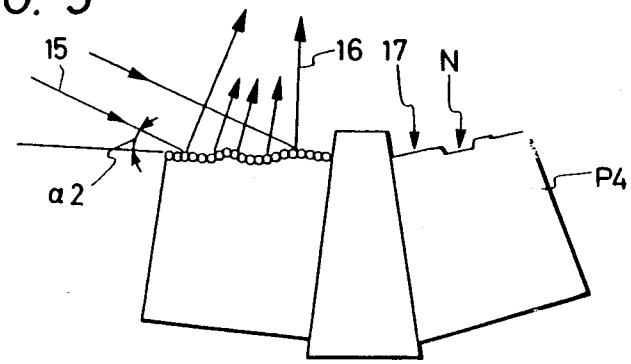
FIG. 5 is an explanatory view showing the reflecting angle of light irradiated from the second projecting means.

FIG. 5 illustrates an example in which the yarn-layer surface has an uneven portion N, such as in the case of a package P4 having a stepped winding, winkles, etc. (see FIG. 10 (IV)). For such a surface, the difference between a bright reflection and a dark reflection is relatively small if light is directed toward the yarn-layer surface at a right angle. Thus, if the angle of irradiation ($\alpha 2$) of the incident light is made as small as possible, the relative difference in the quantity of reflected light 16 between the stepped portion N and the other surface 17 will be more noticeable.

In FIG. 2, the lens 18 is made slidable along an optical axis. The reflected light 19, having passed through the slidable lens 18 provided on the light receiving means 4, may thereby be used to form a real image on a pickup element. An operator can thereby focus the reflected light while viewing through a finder 21 prior to measurement.

Since a light on a radial line in the yarn-layer end of the package is incident upon the pickup element of the image sensor, when the reference is made for example at the outer peripheral edge of the package, the light receiving means 3 and 7 are provided opposite to each other in FIG. 3 in order to adjust the reference in the measuring positions A and B. A reference numeral 35 designates a mirror for reflecting a reflecting light toward the light receiving means 7.

The processing of light information read by the image sensor will be described with reference to FIG. 6. Only one of the measuring positions A and B will be described. The other measuring position is also subjected to similar processing.

A light signal LA obtained by the image sensor 20 is converted into an electric signal. The electric signal is then modified into a signal suitable for processing by an amplifying circuit **23*b* via a noise removing circuit 22*a*. The signal is then converted into a digital signal through an A/D converter 24*a*. The signal is put into a normalizing circuit 25*a* in order to form a signal suitable for comparison with a set level, so that the amplitude of a signal waveform and the like are normalized to be constant. The normalized signal is put into a comparison arithmetical operational circuit 27 via a binary circuit 26*a* for comparison and arithmetical operation with a predetermined level 28**.

A light signal LB obtained by the second light receiving means 7 is processed in a manner similar to the processing of the light signal LA described above. In a case in which the variation in quantity of reflected light is great (such as produced by stepped windings and winkles), a portion having a variation in the quantity of light appears over a relatively wide range of the pickup element. Therefore, in such cases, the A/D converter 24b may be omitted.

Figure 7:
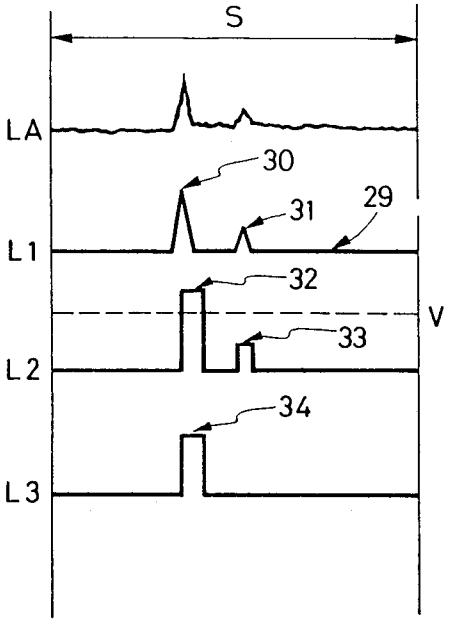
FIG. 7 is an explanatory view of level signals obtained by processing the light information.

Referring now to FIG. 7, the signal LA, after photoelectric conversion of the reflecting light picked up by the image sensor, is identified as electric signal L1. The signal LA is formed into signal L1 through the noise remover **22*a*. The distance S corresponds to the distance S at the measuring position A of the package end in FIG. 3. Here, the low level portion 29 corresponds to a normal yarn-layer plane portion of the package end. The projected high level portion 30 corresponds to a defective portion (such as the cob-webbing or stepped winding) formed on the package surface. The medium level portion 31** does not represent a yarn defect, but is a level resulting from some other disturbance.

The signal L1 is further input to a normalizing circuit **25*a* and a binary circuit 26*a* through an amplifier 23*a* and an A/D converter 24*a*. The signal L1 is thereby converted to a signal L2 suitable for signal level comparison. The binary signal level L2 is compared with a reference level V by the comparison and arithmetic operational circuit 27. In a case in which a signal portion 32 exceeding the reference level V is present, a signal L3 having a rectangular waveform 34 such as L3 in FIG. 7** is put out.

At that time, a level not exceeding the set value V is zero. The set value V may be suitably varied according to the thickness and color of the yarns, the degree of precision of the image sensor, the light intensity of the light source, etc.

Figure 8:
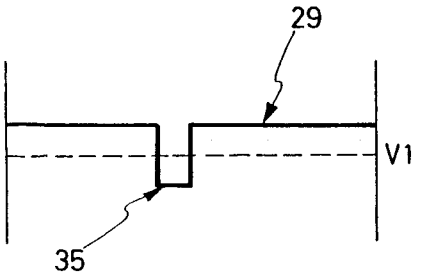
FIG. 8 is a view showing a method for setting a reference level compared with a level signal.

In the above-described example, at level 32 the signal L2 is higher than the set level V. However, as shown in FIG. 8, in other examples a portion 35 lower in level than a level 29 of light information in the normal yarn-layer surface or a standard level sometime occurs. In such cases the reference level V1 is preset to a value smaller than the level 29.

Figure 9:
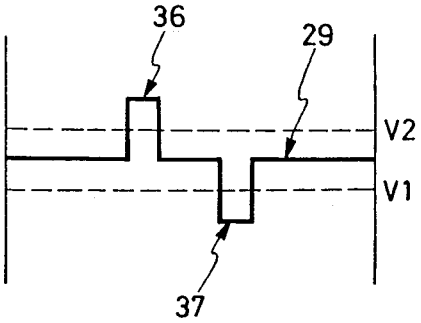
FIG. 9 is a view showing another method for setting a reference level.

Furthermore, as shown in FIG. 9, where level portions 36 and 37 projected from opposite sides of the standard level 29 are present, they may be compared with the set levels V1 and V2 provided on opposite sides of the standard level 29 to obtain a desired signal.

Thus, the first projecting means 3 and the light receiving means 4 enable the detection of a defective package in which the yarn is deviated from the yarn-layer surface (such as cob-webbing). The second projecting means 6 and the light receiving means 7 enable the detection of packages in which the yarn layer surface is uneven (such as stepped winding, winkles, etc.). When a package at the measuring position shown in FIG. 1 is fully rotated around the winding tube K, a defective portion may be detected by either light receiving means 4 or 7.

Figure 6:
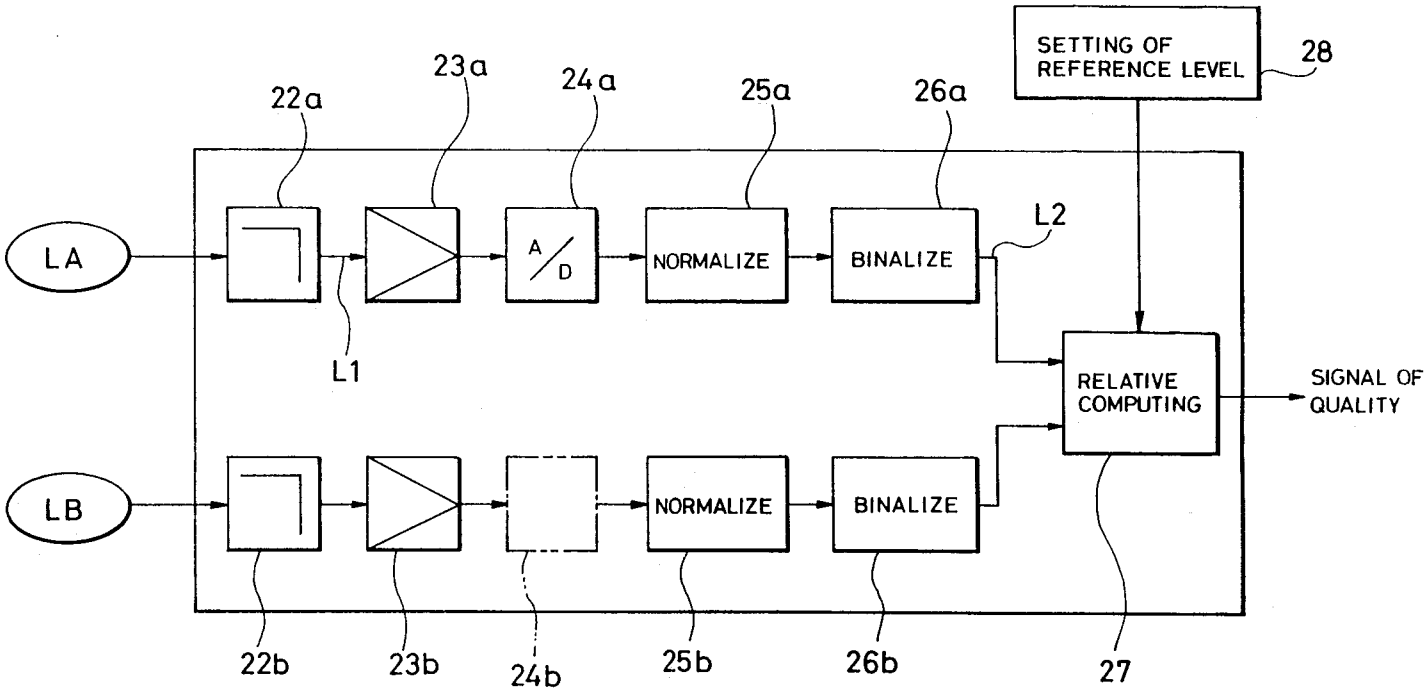
FIG. 6 is a block diagram showing one example of a processing device of light information.

In FIG. 6, if a signal is judged to be defective by at least one of the light information signals LA and LB, a defective signal is released.

It is to be noted, of course, that the inspecting apparatus 1 shown in FIG. 1 may also be installed on the end portion opposite the end T of the package P, to thereby provide further positive winding-form inspection.

As described above, according to the present invention, it is possible to detect even a defective portion of winding-form which involves a possible error in checking by a single light source, thus rendering it possible to perform an inspection of winding-form with high reliability.

What is claimed is:

1. An apparatus for inspecting the winding-form of the yarn surface of a package which has been wound in a winder, said apparatus comprising:

a first winding-form inspecting means for inspecting the winding-form of the yarn surface, said first winding form inspecting means having first projection means for projecting light toward the yarn surface of said yarn package at a first angle of incidence, a second winding-form inspecting means for inspecting the winding-form of the yarn surface, said second winding form inspecting means having second projection means for projecting light toward the yarn surface of said yarn package at a second angle of incidence, said second angle of incidence being smaller than said first angle of incidence, wherein said first winding-form inspecting means further has first reception means for receiving reflected light reflected by the yarn surface of said yarn package projected by said first projection means and generating a first signal in response thereto, wherein said second winding-form inspecting means further has second reception means for receiving reflected light reflected by the yarn surface of said yarn package projected by said second projection means and generating a second signal in response thereto, comparison means for comparing said first signal and said second signal to the predetermined level, whereby defects in the shape of the surface layer of the package are detected.

2. An apparatus for inspecting the winding-form of yarn wound on a yarn package, said apparatus comprising:

first winding-form inspecting means for inspecting the yarn winding-form, said first winding-form inspecting means having a first projecting means for projecting light at a first angle of incidence onto the yarn wound on the yarn package and a first light receiving means for receiving light from said first projecting means upon being reflected from the yarn package;

second winding-form inspecting means for inspecting the yarn winding-form, said second winding-form inspecting means having a second projecting means for projecting light at a second angle of incidence onto the yarn wound on the yarn package and a second light receiving means for receiving light from said second projecting means upon being reflected from the yarn package;

first signal generating means, responsive to the light received by said first light receiving means, for generating a signal in accordance with said light received by said first light receiving means;

second signal generating means, responsive to the light received by said second light receiving means, for generating a signal in accordance with the light received by said second light receiving means; and analyzing means for analyzing the light received by said first and second light receiving means, said analyzing means having a first detecting means for detecting the occurrence of a shadow cast on the yarn by a cob-webbing defect in the winding-form, said analyzing means having a second detecting means for detecting a shadow cast on the yarn by at least one of a stepped winding and a winkle defect in the winding-form, said first and second detecting means comprising:

comparing means for comparing the signal generated by each of said first and second signal generating means with a set level; and third signal generating means, responsive to the comparing means, for generating a defective package signal upon at least one of said first and second signals passing said set level;

wherein said second angle of incidence is smaller than said first angle of incidence.

* * * * *